US009494025B2

(12) United States Patent
Artus et al.

(10) Patent No.: US 9,494,025 B2
(45) Date of Patent: Nov. 15, 2016

(54) CONTROL FRACTURING IN UNCONVENTIONAL RESERVOIRS

(71) Applicants: Vincent Artus, Houston, TX (US); Chih Chen, Houston, TX (US)

(72) Inventors: Vincent Artus, Houston, TX (US); Chih Chen, Houston, TX (US)

( * ) Notice: Subject to any disclaimer, the term of this patent is extended or adjusted under 35 U.S.C. 154(b) by 245 days.

(21) Appl. No.: 14/195,487

(22) Filed: Mar. 3, 2014

(65) Prior Publication Data

US 2014/0246194 A1 Sep. 4, 2014

Related U.S. Application Data

(60) Provisional application No. 61/771,711, filed on Mar. 1, 2013.

(51) Int. Cl.
*E21B 43/26* (2006.01)
*E21B 43/17* (2006.01)
*E21B 43/30* (2006.01)

(52) U.S. Cl.
CPC ..... *E21B 43/26* (2013.01); *E21B 43/17* (2013.01); *E21B 43/305* (2013.01)

(58) Field of Classification Search
CPC .. E21B 43/26; E21B 43/305; E21B 43/2405; E21B 43/17; E21B 43/16; E21B 43/2406; E21B 43/30
USPC ..... 166/271, 52, 370, 266
See application file for complete search history.

(56) References Cited

U.S. PATENT DOCUMENTS 2,753,940 A 7/1956 Bonner
3,700,032 A 10/1972 Terry
3,938,594 A 2/1976 Rhudy
3,954,627 A 5/1976 Dreher
4,005,750 A 2/1977 Shuck
4,022,276 A 5/1977 Dreher
4,084,640 A 4/1978 Allred
4,387,770 A 6/1983 Hill
4,478,282 A 10/1984 Nolte
4,509,598 A 4/1985 Earl
4,515,214 A 5/1985 Fitch
4,548,272 A 10/1985 Norton
4,564,070 A 1/1986 Norton
4,610,160 A 9/1986 Christiansen
4,612,989 A * 9/1986 Rakach ..... E21B 43/2405 166/263
4,621,522 A 11/1986 Christiansen
4,627,273 A 12/1986 Christiansen
4,687,061 A 8/1987 Uhri
4,688,639 A 8/1987 Falk
4,714,115 A 12/1987 Uhri
4,723,605 A 2/1988 Sydansk
4,733,726 A * 3/1988 Alameddine ..... E21B 43/2405 166/271
4,744,418 A 5/1988 Sydansk
4,770,245 A 9/1988 Sydansk (Continued)

FOREIGN PATENT DOCUMENTS

WO WO2008027982 3/2008
WO WO2011010113 1/2011

*Primary Examiner* — Michael Wills, III

(74) *Attorney, Agent, or Firm* — Buche & Associates, P.C.; John K. Buche; Scott D. Compton

(57) ABSTRACT

The application is related to improving recovery of fracturing fluids from subterranean target earth intervals. The application is also related to improving hydrocarbon productivity of subterranean target earth intervals. The application is also related to controlling the development of fractures in subterranean target earth intervals.

16 Claims, 11 Drawing Sheets

(56) References Cited

U.S. PATENT DOCUMENTS 4,779,680 A 10/1988 Sydansk
4,844,168 A 7/1989 Sydansk
4,846,276 A 7/1989 Haines
4,867,242 A 9/1989 Hart
4,869,322 A 9/1989 Vogt, Jr.
4,887,670 A 12/1989 Lord
4,930,575 A 6/1990 Falk
4,995,461 A 2/1991 Sydansk
5,000,264 A 3/1991 Snider
5,002,431 A 3/1991 Heymans et al.
5,018,578 A 5/1991 El Rabaa
5,082,056 A 1/1992 Tackett, Jr.
5,111,881 A 5/1992 Soliman
5,117,912 A 6/1992 Young
5,133,624 A 7/1992 Cahill
5,261,489 A * 11/1993 Jennings, Jr. ..... E21B 43/26 166/271
5,318,123 A 6/1994 Venditto
5,318,124 A * 6/1994 Ong ..... E21B 43/2405 166/272.3
5,327,971 A 7/1994 Garbutt
5,356,565 A 10/1994 Southwell
5,372,195 A 12/1994 Swanson
5,465,790 A 11/1995 McClure
5,482,116 A 1/1996 El-Rabaa
5,495,891 A 3/1996 Sydansk
5,505,074 A 4/1996 Mihcakan
5,513,712 A 5/1996 Sydansk
5,531,274 A 7/1996 Bienvenu, Jr.
5,598,891 A 2/1997 Snider
5,682,951 A 11/1997 Sydansk
5,706,895 A 1/1998 Sydansk
5,711,376 A 1/1998 Sydansk
5,775,426 A 7/1998 Snider
6,002,063 A 12/1999 Bilak
6,047,773 A 4/2000 Zeltmann
6,082,450 A 7/2000 Snider
6,158,511 A 12/2000 Wesson
6,253,851 B1 7/2001 Schroeder, Jr.
6,263,283 B1 7/2001 Snider
6,336,506 B2 1/2002 Wesson
6,386,288 B1 5/2002 Snider
6,761,219 B2 7/2004 Snider
6,938,690 B2 9/2005 Surjaatmadja
7,032,671 B2 4/2006 Aud
7,228,906 B2 6/2007 Snider
7,353,866 B2 4/2008 Snider
7,441,603 B2 * 10/2008 Kaminsky ..... E21B 43/2405 166/266
7,772,162 B2 8/2010 Pope
7,855,169 B2 12/2010 Pope
8,043,998 B2 10/2011 Pope
8,138,127 B2 3/2012 Pope
2002/0033278 A1 3/2002 Reddoch
2006/0200328 A1 9/2006 Guo
2007/0225176 A1 9/2007 Pope
2009/0062155 A1 3/2009 Pope
2009/0223663 A1 9/2009 Snider
2009/0223670 A1 9/2009 Snider
2010/0044041 A1 2/2010 Smith
2010/0137169 A1 6/2010 Pope
2010/0167964 A1 7/2010 Pope
2010/0181068 A1 7/2010 Pope
2010/0224361 A1 9/2010 Pope
2010/0292110 A1 11/2010 Pope
2010/0319920 A1 12/2010 Pope
2011/0017458 A1 1/2011 East
2011/0136704 A1 6/2011 Sharma
2011/0192591 A1 8/2011 Bahorich
2011/0198088 A1 8/2011 Caro
2011/0201531 A1 8/2011 Sharma
2011/0252878 A1 10/2011 Snider
2012/0037373 A1 2/2012 Xu
2012/0067582 A1 3/2012 Fincher
2012/0111560 A1 5/2012 Hill
2012/0111565 A1 5/2012 Garcia-Lopez De Victoria
2012/0111566 A1 5/2012 Sherman
2012/0118566 A1 5/2012 Vandor
2012/0118572 A1 5/2012 Hutchins
2012/0125617 A1 5/2012 Gu
2012/0125618 A1 5/2012 Willberg
2012/0152550 A1 6/2012 East, Jr.
2012/0175121 A1 7/2012 Veatch
2013/0132055 A1 * 5/2013 Preux ..... E21B 43/00 703/10
2013/0199780 A1 * 8/2013 Scott ..... E21B 43/16 166/268

* cited by examiner

CONTROL FRACTURING IN UNCONVENTIONAL RESERVOIRS

CROSS-REFERENCE TO RELATED APPLICATIONS

The application is entitled to the benefit of the filing date of the prior-filed provisional application No. 61/771,711, filed on Mar. 1, 2013.

STATEMENT REGARDING FEDERALLY SPONSORED RESEARCH OR DEVELOPMENT

Not applicable.

FIELD OF THE APPLICATION

The application relates generally to the field of hydraulic fracturing of reservoir rock formations.

BACKGROUND

Considerable volumes of hydrocarbons are currently stored in natural subterranean earth intervals in porous formations of extremely low permeability, many of which are thousands of feet beneath the earth's surface. Such are generally termed "unconventional reservoirs" and may include tight (gas or oil) reservoirs, shale gas, shale oil, or coalbed methane ("CBM") reservoirs. Unconventional reservoirs are typically stimulated for efficient or effective production.

One method of stimulating unconventional reservoirs is accomplished via hydraulic fracturing (or "fracking" or "hydrofracking" as the terms are understood by persons of ordinary skill in the art of drilling operations). Generally, fracking includes drilling a deviated well into an interval, and creating one or more hydraulic transverse fractures in the interval along the well. Once fracturing is achieved, the well may be put on production.

A problem encountered in fracking unconventional reservoirs includes the fast depletion of a completed well. Various factors contribute to this problem. One factor includes the original in-situ stress of an interval, which typically dictates fracture development making the fracturing process difficult to control. For example, induced fractures tend to propagate along the minimum stress direction of a target interval, meaning that fractures may propagate upward and perforate geological layers above a targeted interval resulting in a loss of stimulation efficiency of the interval and/or possible leakage of hydrocarbons and/or fracturing fluids into upper non-targeted interval(s). Another factor includes the low recovery of fracturing fluids injected into an interval, i.e., the low flow back ratio of fracturing fluid injected into an interval. Depending on the permeability, porosity, fluid viscosity and fracturing pressure of an interval, some of the injected fracturing fluid may remain in the fractured network of the interval resulting in less than fifty percent (<50%) recovery of the fracturing fluids. The unrecovered fracturing fluids may plug up the interval lowering the surface availability for hydrocarbon production.

Improved productivity of hydraulically fractured deviated wells is desired.

SUMMARY

The present application is related to a method of improving productivity of a primary deviated well in a subterranean target earth interval, comprising (1) installing a secondary deviated well in the target earth interval substantially laterally aligned with the primary deviated well, the primary deviated well defining a first perforated interval, the secondary deviated well being located at a depth greater than the primary deviated well, the secondary deviated well defining a second perforated interval; (2) fracturing the target earth interval by delivering one or more fracturing fluids into the interval via the primary deviated well; and (3) recovering the one or more fracturing fluids via the primary and secondary deviated wells.

The present application is also related to a method of improving hydrocarbon productivity of a subterranean target earth interval, comprising (1) providing a first deviated well at a first depth within the target earth interval and a second deviated well at a second depth, the second depth being greater than the first depth; (2) injecting pressurized fluid into the second deviated well in a manner effective to modify stress conditions of the target earth interval between the first and second wells; and (3) injecting one or more fracturing fluids into the first deviated well whereby the stress of the target earth interval influences fracture propagation toward the second deviated well.

The present application is also related to a system for fracturing a subterranean target earth formation, including (1) a fracture inducing assembly deliverable to a first location in a target earth formation and operationally configured to induce fractures in the target earth formation; and (2) a pressure inducing assembly deliverable to a second location in the target earth formation and operationally configured to pressurize the target earth formation in a manner effective to induce selective fracture formation from the fracture inducing assembly directionally toward the pressure inducing assembly.

BRIEF DESCRIPTION

Figure 1:
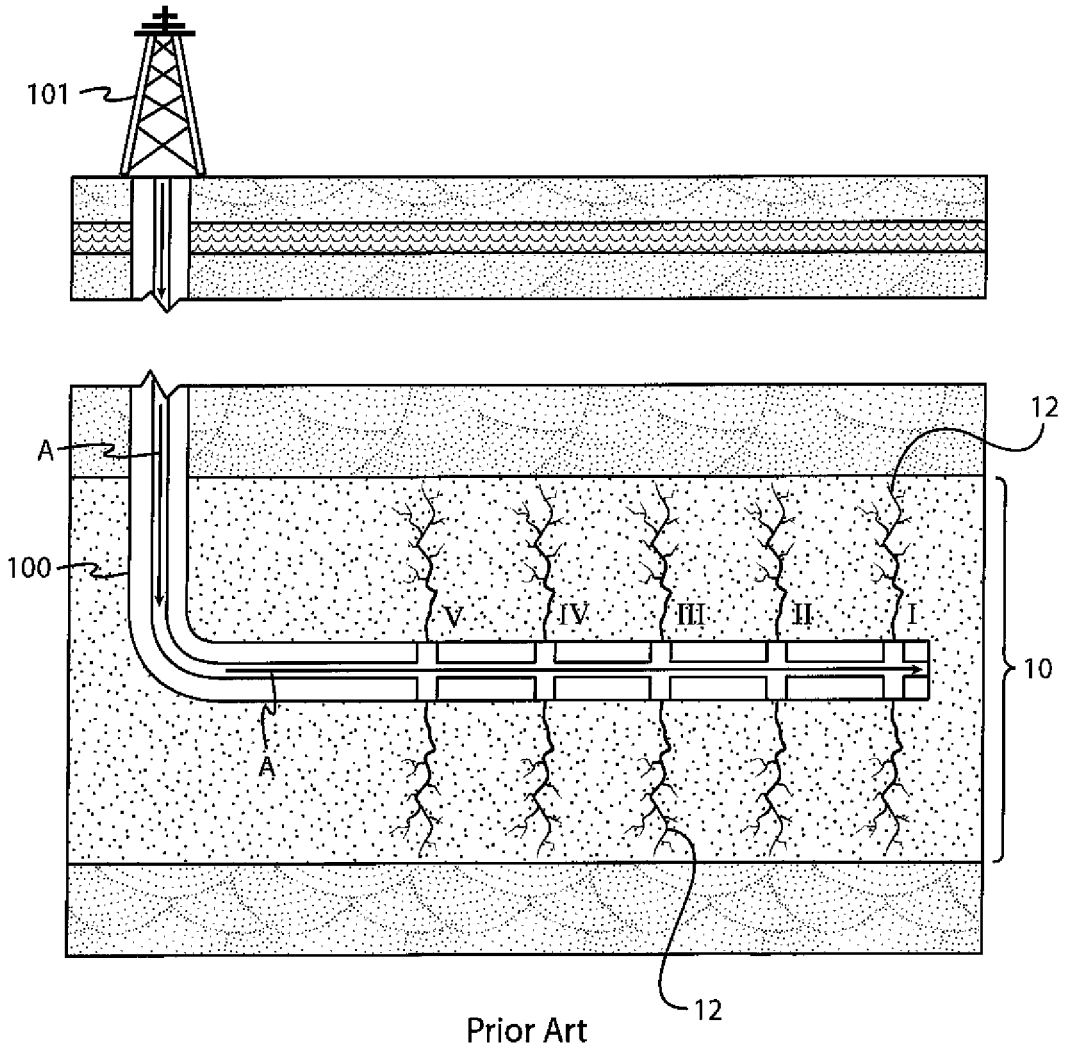
Prior Art FIG. 1
FIG. 1 is a simplified illustration of a fracking technique using a deviated well within a target interval.

Before describing the invention in detail, it is to be understood that the present system and method are not limited to particular embodiments. It is also to be understood that the terminology used herein is for the purpose of describing particular embodiments only, and is not intended to be limiting. As used in this specification and the appended claims, the term "subterranean earth interval" "reservoir interval" or "interval" refers to a subterranean lithologic layer, amongst several layers or intervals, each having a variety of petrophysical properties and initial reservoir conditions such as variations in permeability and initial formation pressures. The term "minifrac," as understood by persons of ordinary skill in the art of drilling, refers to an injection-falloff diagnostic test performed without proppant before a main fracture stimulation treatment. A minifrac typically involves a small-volume, low-flow-rate hydraulic fracturing test performed in an interval to determine the hydraulic fracturing parameters necessary for fracture stimulation of an interval including, but not necessarily limited to: (1) Fracture closure pressure, (2) Instantaneous shut-in pressure ("ISIP"), wherein [ISIP=Final Flow Pressure−Final Flow Friction], (3) Fracture gradient, wherein [Fracture Gradient=ISIP/Formation Depth], (4) Net Fracture Pressure ($\Delta p_{net}$), wherein [$\Delta p_{net}$=ISIP−Closure Pressure], (5) Fluid efficiency, which is the ratio of the stored volume within the fracture to the total fluid injected, (6) Formation leakoff characteristics and fluid loss coefficients, (7) Formation permeability and (8) Reservoir pressure.

The phrase "deviated well" refers to a well that is varied from the true vertical and may include a horizontal well as the phrase is understood by persons of ordinary skill in the art. The phrase "in situ stress" refers to the local forces acting on a lithologic layer in the subsurface. Herein, "fracture gradient" (also referred to as "pressure gradient") is defined as the pressure increase per unit of the depth in a subterranean earth interval due to the density of the interval (measured in pounds per square inch per foot and/or bars per meter). The phrases "fracturing fluid," "fracture fluid," and "fracking fluid" suitably refer to fluid injected into an interval under high pressure to form fractures, cracks or fissures in the interval to allow hydrocarbon based fluids to move freely from interval pores where trapped. Herein, fractures forming an interconnected network of fractures may be referred to as a "fracture network." The phrase "fracture optimization" refers to fracturing of a target interval in a manner effective to maximize recovery of one or more fluids from the interval. Often, fracture optimization may include fracturing that is strong enough to penetrate a target interval and yet weak enough not to break into other non-target intervals. Also, fracture optimization may include the design of the fracking (number of fractures, orientation, choice of fracking sequence) in such a way that the geometry of the created fracture network is more complex, i.e., the surface available for flow inside fractures is maximized. The depth of penetration and aperture size of fractures refers to the "extent" of a fracture network. The phrase "stress anisotropy" refers to the difference in magnitude between a maximum horizontal stress and a minimum horizontal stress of a subterranean interval. As understood by persons of ordinary skill in the art of drilling, suitable fracturing fluids may be gel, foam or water-based fracturing fluids including fluids mixed with friction-reducing additives (often referred to as "slickwater"). Examples include, but are not necessarily limited to high viscosity liquids, oil and water dispersions, oil and water emulsions, water, and combinations thereof. A "proppant" refers to a material operationally configured to keep an induced hydraulic fracture open, during or following a fracturing treatment of an interval. Suitable proppants include, but are not necessarily limited to materials such as grains of sand, bauxite, ceramics, or other particulates that prevent fractures from closing once the injection of fracturing fluids into a target interval is stopped and the pressure of the fracturing fluid in the target interval is reduced. The phrase "formation fluid" may refer to hydrocarbon based fluids such as gas and oil, salt water, fresh water, fracturing fluids, and combinations thereof. The phrase "well production" and variants thereof refers to the recovery of one or more flowable fluids located in a subterranean earth interval.

In one aspect, the application provides a system and method for increasing the productivity of hydraulically fractured horizontal wells in unconventional reservoir intervals by controlling the development of fractures in the interval and/or improving flow back of fracturing fluid from the interval.

In another aspect, the application provides a system and method for increasing or otherwise improving the productivity of deviated wells in unconventional subterranean earth reservoir intervals.

In another aspect, the application provides a system and method for fracturing a subterranean earth reservoir interval to facilitate the recovery of subterranean resources including, but not necessarily limited to energy resources such as hydrocarbon based fluids like oil and gas.

In another aspect, the application provides a system and method for modifying the effective stress in a subterranean earth reservoir interval in order to control fracture formation in the interval for improving and/or increasing the efficiency of hydrocarbon based fluid recovery from the interval.

In another aspect, the application provides a system and method for controlling the fracturing process and the flowback of fracturing fluid(s) in a subterranean earth reservoir interval using a primary well for injecting fracturing fluid(s) into an interval at a first location and a secondary deviated well for controlling or modifying the effective stress of the interval and capturing the fracturing fluid(s). Suitably, pressurized fluid is deliverable to an interval at a second location via the second deviated well. Modifying the effective stress helps control the fracture development. It is the location and/or orientation and/or position of the secondary well (located below the primary well) that assists the recovery of fluids via gravity effects as explained further in this application.

In another aspect, the application provides a system and method for controlling the fracturing process and the flowback of fracturing fluid(s) in a subterranean earth reservoir interval using a primary well for injecting fracturing fluid(s) into an interval and a secondary deviated well for inducing fracture formation toward the secondary deviated well.

In another aspect, the application provides a system and method for improving the productivity of deviated wells in liquid rich subterranean earth reservoir intervals using a first deviated well to produce gas from the interval and a second deviated well to produce liquid(s) from the interval. Because oil or gas condensate may naturally accumulate near the bottom of an interval due to gravity, the second deviated well may be located at a depth greater than the first deviated well.

In another aspect, the application provides a system and method for recovering fracturing fluid from a fracture network of a subterranean earth reservoir interval located below the wellbore used for fracking operations.

In another aspect, the application provides a system for redistributing the stress in a subterranean earth reservoir interval to control fracture propagation and fracture volume therein.

In another aspect, the application provides a method of analyzing reservoir interval data for the implementation of multi-well systems for increasing productivity of hydraulically fractured intervals.

In another aspect, the application provides simulation methodology operationally configured to assist in the implementation of multi-well systems for increasing productivity of hydraulically fractured intervals.

In another aspect, the application provides a system and method for well stimulation to increase production by improving the flow of hydrocarbons from the drainage area of a reservoir interval into a secondary well bore.

In another aspect, the application provides a multi-well system and method for correcting the stress in a subterranean earth reservoir interval to control fracture formation in the interval. The direction of the corrected stress will be such that fractures initiated at a primary well will tend to propagate downward toward a secondary well in the vicinity of the fractured well. The multi-well system does not prevent fractures to expand laterally as in a classical fracturing job. After a fracturing operation has completed, the secondary well may be put on production, first to recover the fracturing fluids lying in the stimulated fracture network, and/or to assist the primary well during production as desired.

In another aspect, the application provides a multi-well system and method for correcting the stress in a subterranean earth reservoir interval to control the propagation of the fracture and the injection fluids to reduce the possible perforation of non-target intervals, aquifers and other non-target subterranean formations. Computer programs and/or simulation techniques may also be employed to help determine the optimum fracture penetration geometry and optimum fracture conductivity for a target interval for controlling fracture propagation.

DISCUSSION OF THE INVENTION

The producibility of hydrocarbons typically depends on the permeability of the rock formation of the target interval. Where permeability is low, fracturing operations may be employed to increase the fracture surface area of a target interval, i.e., create additional flow paths so that hydrocarbons, such as oil and gas, may flow more easily through the rock formation for retrieval purposes. Known fracking techniques typically involve the installation of a deviated well (such as a horizontal well) laterally a desired distance along a target interval followed by pumping fracturing fluid under pressure into the interval to form a fracture network therein. Depending on the size of the interval to be produced, it is not uncommon for a deviated well to be drilled laterally into a target interval up to about 1524.0 meters or more (up to about 5,000 feet or more), whereby up to about 23.0 million liters (6.0 million gallons) may be pumped into the interval to form a desired fracture network.

Often, the pressure build-up in a target interval is achieved in stages along the length of a deviated well by isolating portions of the well. In staged fracturization, a deviated well is suitably fractured sequentially beginning at the stage nearest the distal end of a well, moving uphole as each stage of the fracking treatment is completed until the entire deviated well has been stimulated. A simplified staged fracking technique is illustrated in FIG. 1. As shown, fracturing fluid may be pumped (see directional arrow "A") through a subterranean deviated well 100 from a surface location 101 into a target interval 10 in successive stages (I-V) at a rate sufficient to increase pressure beyond the pressure gradient of the target interval 10. In other words, the fracturing fluid pressurizes the target interval 10 to a point where the in-situ stress levels surrounding the well 100 reach a critical breaking strength so as to initiate fractures 12 (also commonly referred to as "fissures"). Once the target interval 10 begins to fracture, the fracturing fluid continues to travel further into the target interval 10 away from the well 100 forming a fracture network 12. As understood by the skilled artisan, when a fracturing process is deemed to be completed, pressure is released at the deviated well 100 to promote the flow back of the fracturing fluid back up through the deviated well 100.

As understood by persons of ordinary skill in the art, fractures 12 typically propagate in opposite directions from a well 100 as shown in FIG. 1. Moreover, fractures 12 typically form in the direction perpendicular to the least stress in a bi-wing configuration as shown in FIG. 1. At depths less than about 610.0 meters (about 2000 feet) horizontal fractures are typically formed due to the Earth's overburden stress at such depths providing the least in-situ stress. As depth increases beyond about 610.0 meters (about 2000 feet), overburden stress increases by about 22.6 kPa/m (about 1.0 psi/ft) making the overburden stress the dominant stress, meaning the horizontal confining stress is now the least principal stress. Since hydraulically induced fractures are formed in the direction perpendicular to the least stress, the resulting fractures at depths greater than about 610.0 meters (about 2000 feet) are typically oriented in the vertical direction as shown in FIG. 1. Where a fracture crosses over a boundary where the principal stress direction changes, the fracture will attempt to reorient itself perpendicular to the direction of least stress. For example, if a fracture propagates from a deeper to shallower interval the fracture may reorient itself from a vertical to a horizontal pathway and spread sideways along the bedding planes of the rock strata of the interval.

For the purposes of this application, fracture optimization may include the intentional propagation of fractures 12 beyond a target interval 10. However, in most instances, fracture optimization suitably refers to maintaining fracture propagation within the uppermost and lowermost edges or borders of a target interval 10 as shown in FIG. 1. By controlling fracture propagation, operators save time and money related to both material costs and operational expenditures otherwise endured in the presence of undesired fracture networks 12. The present invention provides a new and desirable approach in this regard. Another benefit is that environmental hazards are reduced, since controlling the fracture propagation reduces the risk of perforating shallower formations, intervals or layers, e.g., an aquifer. Thus, the risk of releasing undesired fracturation fluids in non-target intervals is reduced according to the teachings of the present invention.

Prior to drilling a deviated well, it is important for operators to characterize a target interval in an attempt to predict how the interval will respond to the injection of fracturing fluid and proppant therein. Suitably, knowledge of one or more formation characteristics including in-situ properties (or in-situ stress conditions) may be used by operators to help determine fracture penetration geometry and fracture conductivity for a target interval. Exemplary in-situ properties include, but are not necessarily limited to (1) the stress regimes affecting the stress anisotropy of a target interval, (2) the stress anisotropy of a target interval, (3) the presence, degree, and/or orientation of any natural fractures in a target interval (which may affect how a fracture forms in a target interval), (4) the mechanical properties of a target interval (to determine the "brittleness" of a target interval), (5) the permeability of a target interval, (6) the closure pressure (which is often the minimal horizontal stress), and combinations thereof. In-situ properties may be ascertained using down hole well log analysis or surveys, e.g., open hole logs, core data, offset well data, and cased hole logs, from which formation lithologies and mechanical rock properties (such as formation Poisson's Ratios and Young's Moduli) can be interpreted to help estimate the stimulated reservoir volume ("SRV") of an interval and the identity of any faults that may cause unintended negative effects during fracking operations.

In addition to performing a formation evaluation to ascertain various formation characteristics, simulation techniques may also be employed to help determine the optimum fracture penetration geometry and optimum fracture conductivity for a target interval. For example, numerical simulations may be employed to determine (1) the optimum wellbore stage size and/or design, (2) the optimum distance between perforation clusters for each fracture stage, (3) the optimum number of perforation clusters for each fracture stage, (4) the optimum number of perforations per cluster, (5) the optimum length of perforated intervals, (6) the optimum location to place clusters, (7) the optimum volume of fracturing fluid to be pumped into the target interval, (8) optimum proppant mass, (9) the injection rate of the fracturing fluid, and combinations thereof as each of the above is understood by the skilled artisan. Suitable simulation techniques may include, but are not necessarily limited to modeling, microseismic fracture mapping (or "microseismic monitoring"), tilt-meter analysis, and combinations thereof.

One or more of the above described parameters may be employed as part of the present invention for increasing the productivity of hydraulically fractured horizontal wells in unconventional reservoir intervals by controlling the development of fractures in the interval and/or improving flow back of fracturing fluid from the interval.

Improved Flow Back Ratio of Fracturing Fluid

As understood by those of ordinary skill in the field of fracking, operators typically try to maintain "fracture width" or slow fracture decline by introducing into the injected fracturing fluid one or more proppants operationally configured to prevent fractures 12 from closing. Propped fractures are meant to be permeable enough to allow formation fluids and fracturing fluid to flow through the fractures 12 into a well 100 for recovery. Yet, in known fracturing operations (as depicted in FIG. 1) an amount of the fracturing fluid unfortunately remains in the induced fractures 12 and connected fissures unrecovered—up to about 50.0 percent or more of fracturing fluid is not uncommon. For example, in an instance where the volume of fracturing fluid pumped into a target interval 10 is about 15,141.60 kL (about 4.0 million gallons), about 7,500 kL (about 2.0 gallons) or more of the fracturing fluid may remain in the fractured network unrecovered. Due to gravity, a majority of the unrecovered fracturing fluid is typically located in those fractures 12 located below the well 100 (see FIG. 1). Unrecovered fracturing fluid may plug the target interval 10 below the well 100 resulting in lower than desired hydrocarbon productivity.

Figure 2:
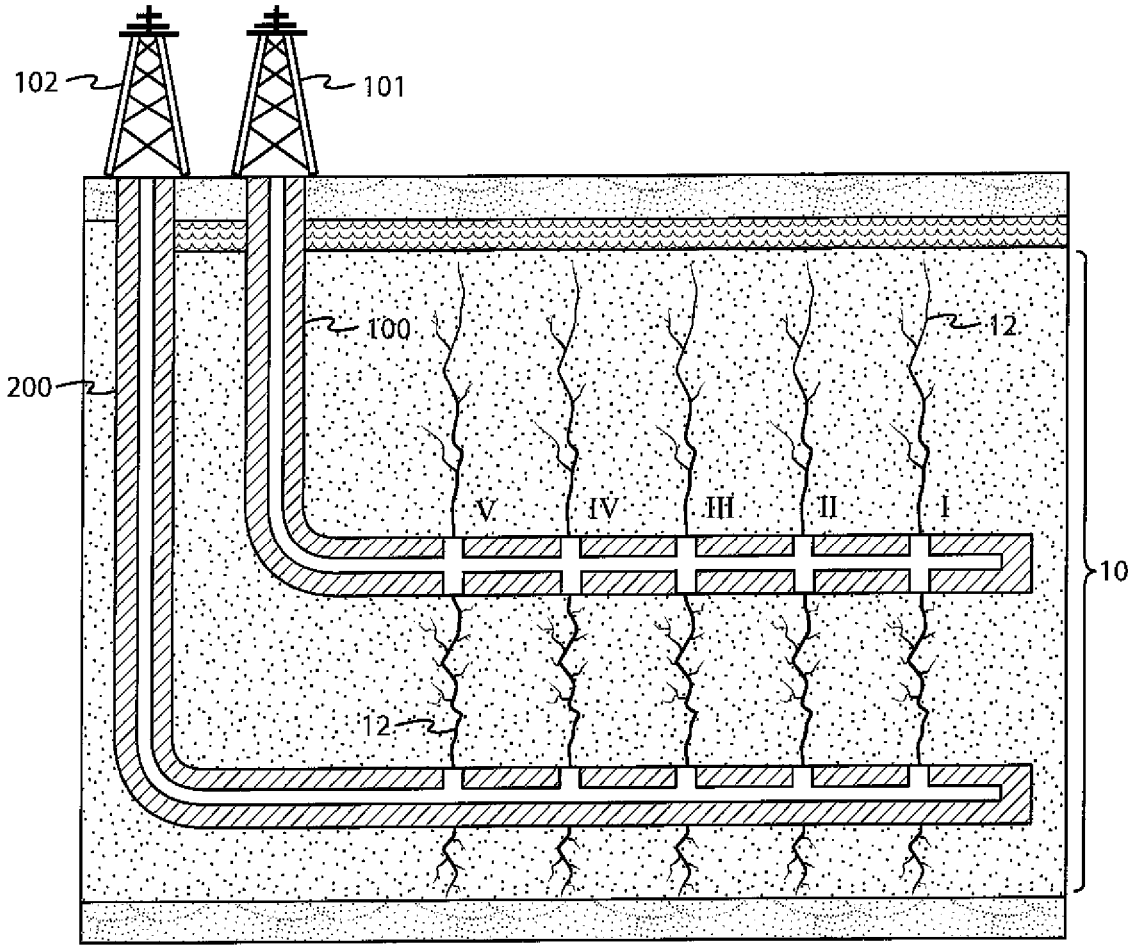
FIG. 2 is a simplified illustration of a fracking technique using a second deviated well at a depth below a first deviated well.

To improve the flow back ratio of fracturing fluid injected into a target interval 10, this application provides for a second deviated well 200 that may be installed at a depth below a first deviated fracturing well 100 to assist in recovery of fracturing fluid (see FIG. 2). In one suitable embodiment, a second deviated well 200 may be installed below a pre-existing first deviated well 100 following fracking operations. In another suitable embodiment, dual deviated wells 100, 200 may be installed concurrently prior to fracking operations to improve the flow back ratio of fracturing fluid (see FIGS. 3 and 4). In another suitable embodiment, a second deviated well 200 may be installed prior to a first deviated well fracturing well 100.

Figure 3:
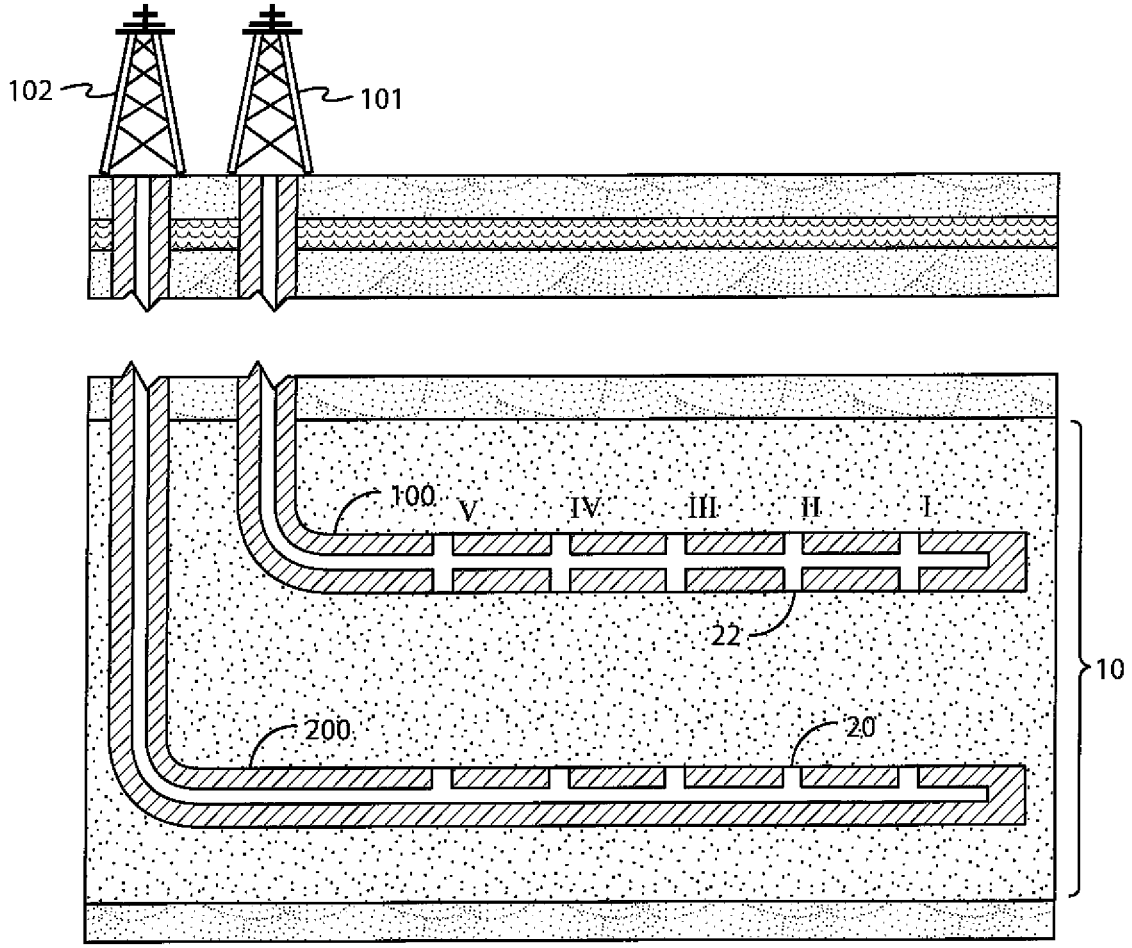
FIG. 3 is a simplified illustration of dual deviated wells installed within a target interval illustrating staged perforations along each of the wells.
Figure 4:
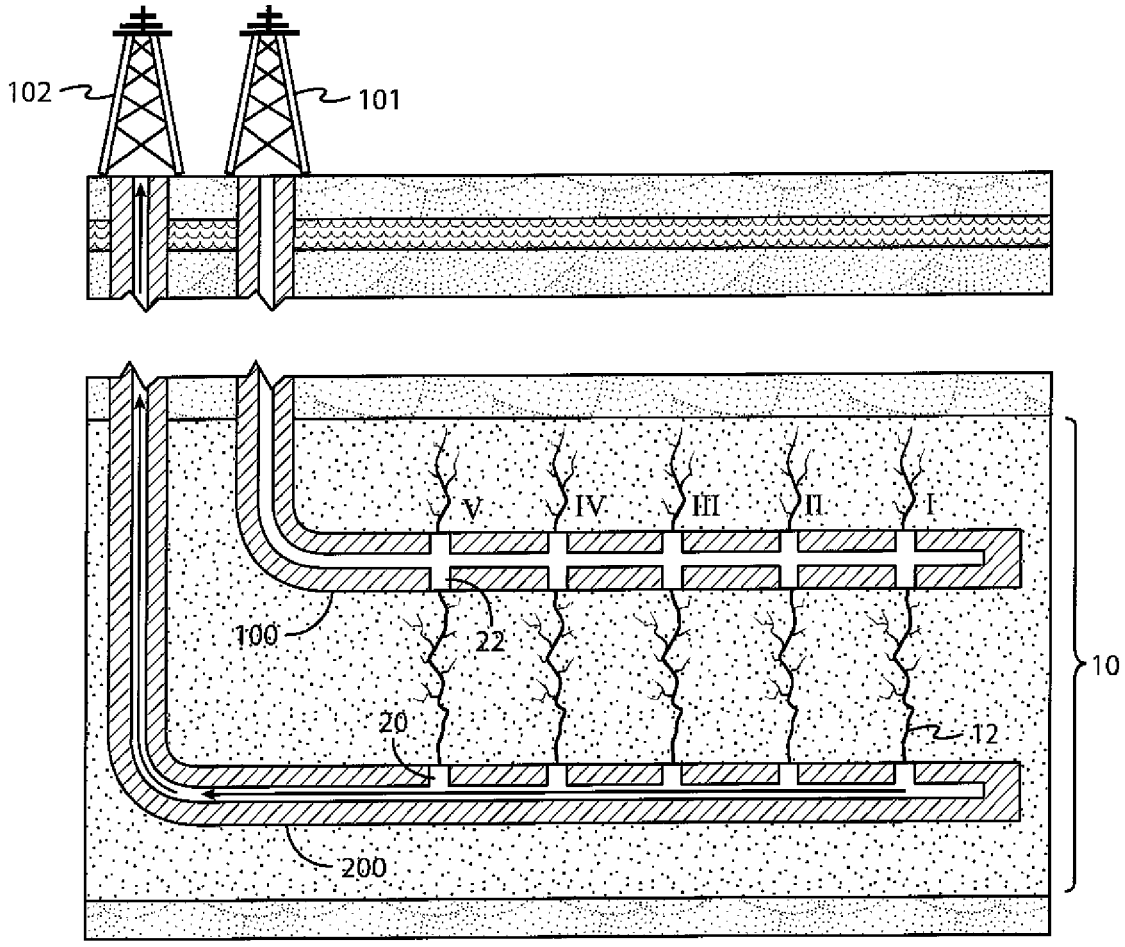
FIG. 4 is a simplified illustration of the dual deviated wells of FIG. 3 illustrating a fracture network above the lowermost deviated well.

In the embodiment of FIGS. 3 and 4, a first deviated well 100 operationally configured to deliver or otherwise inject fracturing fluid into a target interval 10 is suitably drilled to a first depth within a target interval 10. A second deviated well 200 operationally configured to capture or otherwise recover fracturing fluid and hydrocarbon based fluid from the target interval 10 is suitably drilled to a second depth within the target interval 10—a depth determined according to the one or more in-situ characteristics of the target interval 10 whereby the second deviated well 200 engages at least part of the fractured network 12 propagating from the first deviated well 100 as depicted in the simplified illustration of FIG. 4. In one embodiment, the second deviated well 200 may be installed after fracking operations have commenced whereby the depth of the second deviated well 200 may be determined according to post-fracking in-situ characteristics of the target interval 10. In another embodiment, the second deviated well 200 may be installed prior to fracking operations whereby the depth of the second deviated well 200 may be determined according to pre-fracking in-situ characteristics of the target interval 10.

As shown, a second deviated well 200 is suitably installed in substantial alignment with the first deviated well 100 in a manner effective to maximize the capture and recovery of fracturing fluid injected into the target interval 10 via the first deviated well 100. In one suitable embodiment, the perforated interval of the second deviated well 200 is about equal to or greater than the perforated interval of the first deviated well 100. For example, in an embodiment where the deviated wells 100, 200 are horizontal wells, the second deviated well 200 suitably lies in substantially parallel alignment with the first deviated well 100 at a length about equal to or greater than the length of the first deviated well 100. At a minimum, the second deviated well 200 suitably lies in substantially parallel alignment with the first deviated well 100 at a length effective for recovery of fracturing fluid injected into the target interval 10 at the distal stage, e.g., Stage I, of the first deviated well 100. In one suitable embodiment, the length of the second deviated well 200 engages substantially all of the fracture network 12.

In one embodiment involving staged fracturing, a second deviated well 200 suitably includes one or more openings disposed along the length of the second deviated well 200, e.g., perforations 20 disposed along the length of the second deviated well 200 as desired for capturing fracturing fluid delivered by the first deviated well 100. In another embodiment using staged fracturing, perforations 20 may be disposed along the length of the second deviated well 200 in a manner corresponding to perforations 22 disposed along the first deviated well 100 (see FIG. 3). In another embodiment, the second deviated well 200 may include an open hole lengthwise along the well 200. In another embodiment, the second deviated well 200 may include more perforations than the first deviated 100. Although the system of the present application may be built to scale, in most fracking operations as performed on the continent of North America, perforations 20 of the second deviated well 200 may have a width (or diameter) up to about 0.00635 meters (about 0.017 feet). Without limiting the invention, fracturing stages are typically set apart along a wellbore from about 60.0 meters to about 150.0 meters (from about 200.0 feet to about 500.0 feet).

In use, once fracturing operations are completed the first and second deviated wells 100, 200 may act in concert to recover fracturing fluid and hydrocarbon based fluids from a target interval 10. Depending on one or more in-situ properties of a target interval 10, the addition of a second deviated well 200 suitably increases recovery of fracturing fluid from a target interval 10 by up to about 50.0 percent or more and increases hydrocarbon based fluid production up to about 90.0 percent or more compared to use of a single deviated well 100 alone. For example, in an embodiment where the recovery of fracturing fluid from a target interval 10 increases by about 30.0% productivity of the target interval 10 may increase by about 30.0%. Thus, for the purposes of this application a direct correlation may exist between improved fracturing fluid recovery and improved well production when incorporating a multi-well system for recovery of fracturing fluid.

Control Fracturing and Production Optimization

Figure 5:
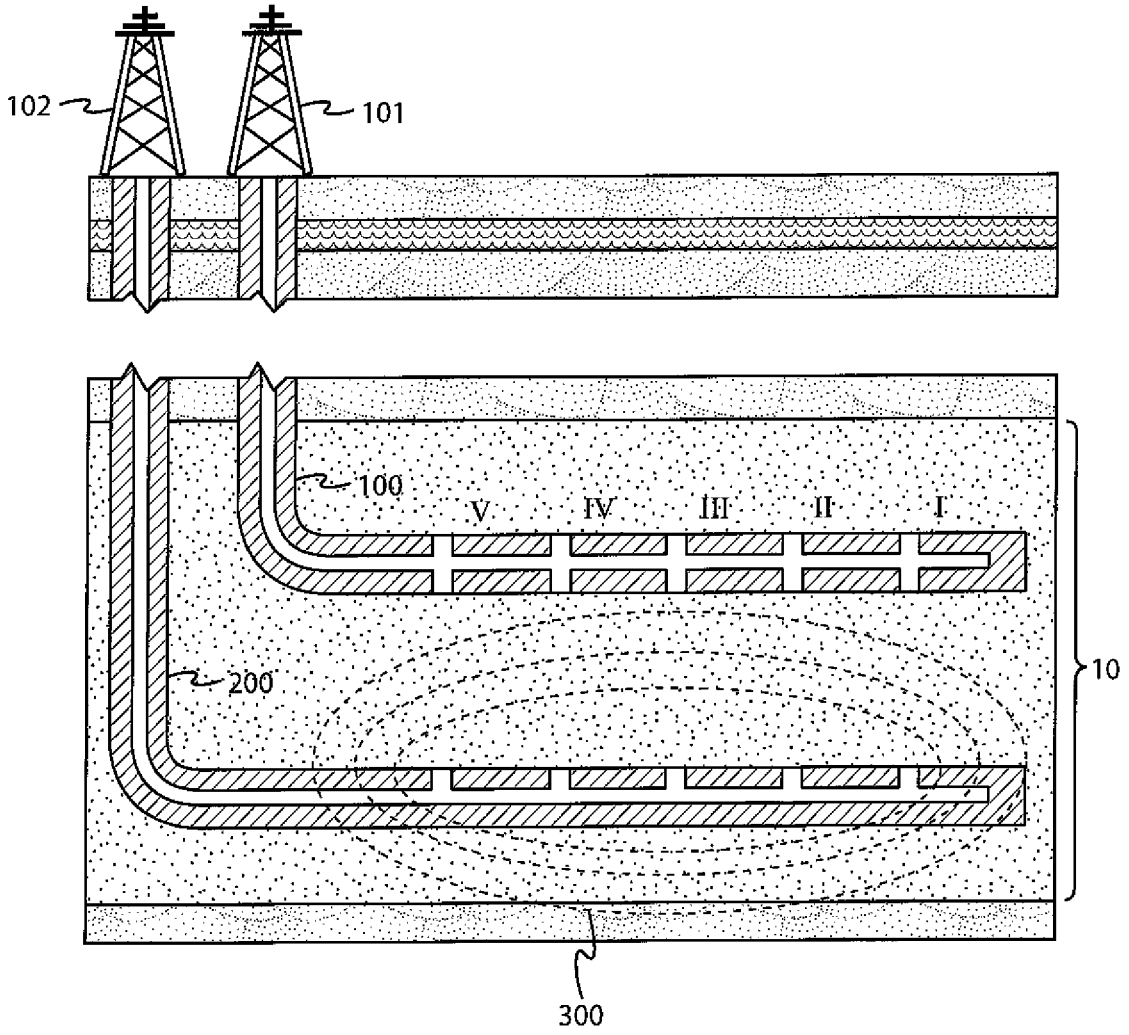
FIG. 5 is a simplified illustration of dual deviated wells installed within a target interval including a lowermost well for inducing pressure rise within the target interval.

In addition to improving the flow back ratio of fracturing fluid, it has also been realized that a second deviated well 200 may be used to pressurize or stimulate a target interval 10 prior to and/or during hydraulic fracturing to modify the in-situ stress of the target interval 10 in the vicinity of a first deviated well 100 (see the broken lines 300 in FIG. 5, which represent the induced pressure rise within the target interval 10 generated by the second deviated well 200). Herein, the modification of the in-situ stress provides an increase in overall fracture volume as well as fracture propagation in a desired direction from the first deviated well 100 toward the second deviated well 200.

In other words, a second deviated well 200 may be employed to pressurize a target interval 10 in the vicinity of a first deviated fracturing well 100 up to a pressure just below the fracturization pressure of the target interval 10. Pressurization of the target interval 10 via the second deviated well 200 is effective to correct the effective stress near the first deviated fracturing well 100. This modification of the effective stress directs or otherwise provides for fracture propagation from the first deviated fracturing well 100 to the second deviated well 200—the direction of minimum stress. In addition, pressurization of the target interval 10 via the second deviated well 200 provides an increased fracture volume resulting in increased flow of fracturing fluid from the first deviated well 100 toward the second deviated well 200 for recovery purposes. Once fracturing operations are completed, the second deviated well 200 may be put on production (1) to recover fracturing fluid, (2) to assist the first deviated well 100 in well production or (3) both.

Figure 6:
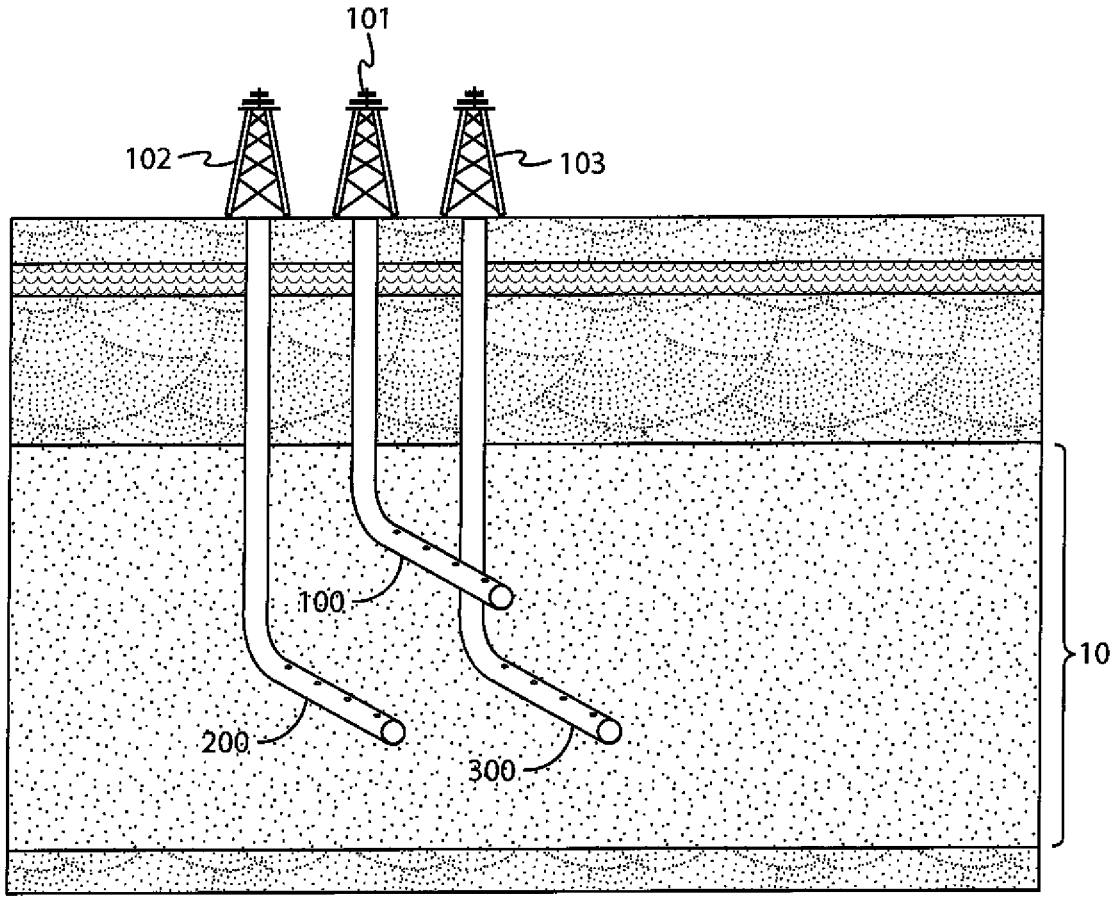
FIG. 6 is a simplified illustration of a multi-well system of the application.

In another embodiment as shown in FIG. 6, it is contemplated that two or more secondary deviated wells 200, 300 may be employed to pressurize a target interval 10 in the vicinity of a first deviated fracturing well 100 up to a pressure just below the fracturization pressure of the target interval 10 in a manner effective to recover fracturing fluid there from and to assist the first deviated well 100 in well production. It is also contemplated that two or more primary deviated wells may be used to deliver fracturing fluid into a target interval 10 as desired. Without limiting the invention, surface locations 101, 102 and 103 may be situated as desired or as otherwise required according to one or more factors at both the surface level and below the surface.

Without limiting the invention, one suitable mode of implementation includes determining or otherwise identifying one or more formation characteristics of a target interval 10 to establish criteria that may be effective for both interval fracturing and recovery operations prior to the drilling of any of the deviated wells. Exemplary formation characteristics may include, but are not necessarily limited to (1) the initial pressure of a target interval 10, (2) the fracturization pressure of a target interval 10, (3) the permeability of a target interval 10, (4) the depth of a target interval 10, (5) the cubic area of the rock formation of the target interval 10, (6) distribution of in situ stress in the target formation and in neighbor formations, and combinations thereof. As understood by persons in the art of drilling, the initial pressure of a target interval 10 (also commonly referred to as "initial reservoir pressure") refers to the virgin or original pressure of a target interval 10 and corresponds to the drill stem test ("DST") pressure. The fracturization pressure or "frac pressure" of a particular target interval 10 is the pressure at which an interval 10 begins to fracture under pressure. The frac pressure may be determined by performing a minifrac in the interval 10. The permeability of a target interval 10, i.e., the measurement of an interval's ability to transmit fluids, may be determined via well tests including, but not necessarily limited to core analysis, nuclear magnetic resonance log ("NMR"), wireline formation tester, drill stem test ("DST"), and combinations thereof. Exemplary criteria may include, but are not necessarily limited to the size and length of the deviated wells 100, 200, the orientation of the deviated wells 100, 200, the depth of the deviated wells 100, 200, i.e., the distance between the first deviated well 100 and the second deviated well 200, the fracturing fluid(s) to be used, the duration of stimulation (or duration of pressurization) of the interval 10 and the duration of fracturing of the interval 10. By establishing one or more of the above parameters, the present system and method are operationally effective to optimize hydrocarbon productivity of the target interval 10.

In one suitable mode of operation, once a target interval 10 is selected for production purposes, the target interval 10 may be evaluated to determine one or more formation characteristics as described above. Once one or more formation characteristics are determined, the information may be used to establish desired system criteria according to any number of calculations and/or computer simulations. For example, once the fracturization pressure, permeability and depth of a target interval 10 are known, first and second deviated wells 100, 200 may be installed at depths effective for the second deviated well 200 to pressurize the target interval 10 a duration effective to correct the in-situ stress near the first deviated well 100. Typically, once the optimum duration of pressurization is met using the second deviated well 200, an operator may commence pressurization, and fracturing, of a target interval 10 via the first deviated well 100.

Herein, an optimal duration of pressurization may be defined as the amount of time necessary to pressurize the target interval 10 to modify the in-situ stress of the target interval 10 in the vicinity of a first deviated well 100 in order to form a desired fracture network volume between the deviated wells 100, 200. If pressurization lasts too long, then too much of the interval 10 may be pressurized resulting in undesirable fracture formation within the target interval 10. If pressurization is too short, then the effective stress near the first deviated well 100 may not be modified to form a desired fracture network volume between the deviated wells 100, 200. Thus, calculations including computer simulations may be employed to determine optimal pressurization and duration thereof based on input data related to one or more of the above described parameters.

Generally, the distance between the first and second deviated wells 100, 200 includes a distance effective to produce a large volume fracture network above the second deviated well 200 whereby the second deviated well 200 engages at least a portion of the fracture network. As shown in the simplified embodiment of FIG. 7, an optimal distance between the first and second deviated wells 100, 200 is that distance effective to produce a large volume fracture network 12 (see fracture network labeled 12A) between the first and second deviated wells 100, 200 whereby the second deviated well 200 engages at least a portion of the fracture network 12. An optimal distance between wells 100 and 200 may also be described as a distance effective to prevent fractures from propagating beyond either the uppermost edge of the target interval 10 (see fracture network labeled 12B) or the lowermost edge of the target interval 10. In one embodiment, about 80.0 percent or more of the fracture network 12 is suitably located above the second deviated well 200. In another embodiment, about 90.0 percent or more of the fracture network 12 is suitably located above the second deviated well 200. As such, there is a correlation between the volume of the fracture network 12 located above the second deviated well 200 and the flow back ratio of fracturing fluid. Generally, the greater the volume of the fracture network 12 located above the second deviated well 200 the greater the flow back ratio of fracturing fluid.

It is also contemplated that the distance between wells 100, 200 may be determined according to one or more time considerations. For instance, a particular target interval 10 may require fracturing to be performed within a certain period of time. Likewise, an operator may desire to produce a target interval 10 by a certain future date. In a simplified example, if a target interval 10 has a known depth, permeability and fracturization pressure and the first and second deviated wells 100, 200 are set apart a known distance, calculations, including for example computer simulations, may be employed to determine the amount of time required for the second deviated well 200 to optimally correct the stress in the vicinity of the first deviated well 100 without reaching the fracturization pressure of the target interval 10. If an operator desires to put the same interval 10 on production more slowly or more quickly, calculations, including for example computer simulations, may be employed to determine new depths for each of the first and second deviated wells 100, 200. For example, if an operator desires for the interval 10 to be put on production more quickly than realized via initial calculations or simulations, the operator may perform additional calculations and/or simulations to determine how much closer the first and second deviated wells 100, 200 may need to installed downhole while still achieving desired stress correction in the vicinity of the first deviated well 100 without reaching the fracturization pressure of the target interval 10. In cases where the interval is very thick and/or the permeability is extremely low, the optimum distance between the wells depends on an acceptable time required to pressurize the system before fracking. For example, if an interval is about 400.00 meters (about 1312.34 feet) thick top to bottom, an operator may set the two deviated wells 100, 200 about 91.44 meters (about 300.00 feet) apart, in order to maximize the proportion of the interval that is to be stimulated. In such a case, however, it may be necessary to pressurize for a very long time before stress is efficiently modified in the vicinity of the primary well 100. If a set time is unacceptable for operational reasons, it may be necessary to reduce the distance between the two deviated wells 100, 200. In such case, stress modification is achieved faster in the vicinity of the primary well 100, but the fracture depth achieved may be reduced.

In still another embodiment, it is contemplated that wells 100, 200 may be installed in a target interval 10 where the formation characteristics are not known. In such embodiment, the first deviated well 100 and the second deviated well 200 may be installed according to one or more baseline considerations or parameters effective to provide desired fracture formation within the target interval 10. For example, once the depth of a target interval 10 is determined, a first deviated well 100 may be installed near the uppermost border of a target interval 10 at a depth from about 0.125 to about 0.40 the total depth of the target interval 10. In one particular embodiment, the first deviated well 100 may be installed at a depth of about one-third (⅓) the depth of the corresponding interval 10 (see for example FIG. 7)—which may be referred to herein as a baseline depth of the first deviated well 100. In addition, the second deviated well 200 may be installed in the target interval 10 below the first deviated well 100 at a depth from about 0.60 to about 0.95 the depth of the target interval 10. In one particular embodiment, the second deviated well 200 may be installed at a depth of about two-thirds (⅔) the depth of the corresponding interval 10 (see FIG. 7)—which may be referred to herein as a baseline depth of the second deviated well 200.

Absent information regarding the formation characteristics of a target interval 10, it is further contemplated that information may be collected regarding other similar intervals to generate calculations, including for example computer simulations, to determine system criteria including, but not necessarily limited to the size and length of the deviated wells 100, 200, the orientation of the deviated wells 100, 200, the depth of the deviated wells 100, 200, the fracturing fluid to be used, the duration of pressurization of the interval 10, the duration of fracturing of the interval 10, and combinations thereof. In one example, a downhole pressure gauge may be set close to the perforation of a first deviated well 100. When the second deviated well 200 starts pressurizing the interval 10, an operator may record pressure at the first deviated well 100 until pressure starts rising. Once sufficient pressure variation has been recorded at the first deviated well 100 the effective stress has been efficiently modified below the first deviated well 100 and fracking operations may be initiated.

The invention will be better understood with reference to the following non-limiting examples, which are illustrative only and not intended to limit the present invention to a particular embodiment.

EXAMPLE 1

Figure 7:
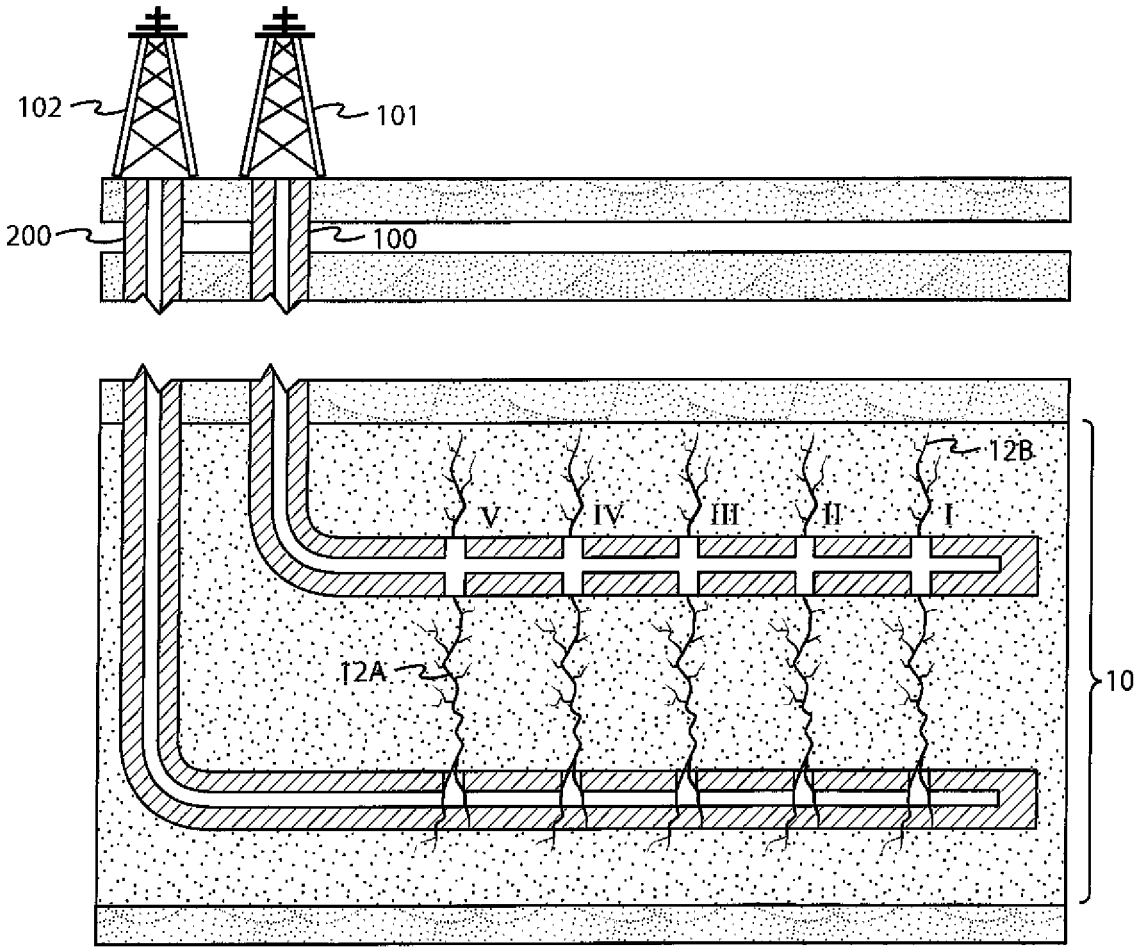
FIG. 7 is a simplified illustration of dual deviated wells installed within a target interval illustrating a large volume fracture network between the wells.

In a first non-limiting example, an unconventional reservoir of a target interval 10 is selected for production purposes. Prior to fracturing operations, the depth of the target interval 10, the cubic area of the rock formation of the target interval 10, the fracturization pressure of the target interval 10 and the permeability of the target interval 10 are determined. The depths of the first and second deviated wells 100, 200 are initially set according to their baseline depths of ⅓ and ⅔ as shown in FIG. 7.

Using this data, one or more computer model simulations are run at varying durations according to a stimulation pressure level just under the fracturization pressure of the interval 10 to identify an optimal duration of stimulation of the target interval 10 according to the baseline depths of the first and second deviated wells 100, 200. The duration of stimulation is defined as the time necessary to pressurize the target interval 10 to modify the in-situ stress of the target interval 10 in the vicinity of a first deviated well 100 at its baseline depth.

Figure 8A:
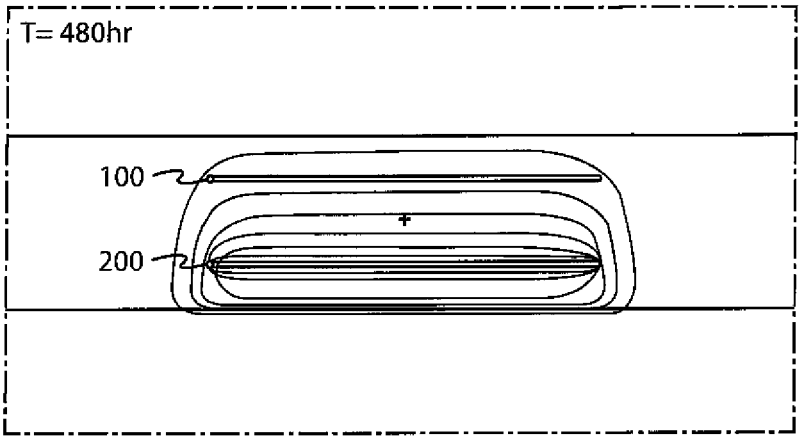
FIG. 8A is a first view of a simplified illustration of a computer simulation according to the present invention.
Figure 8B:
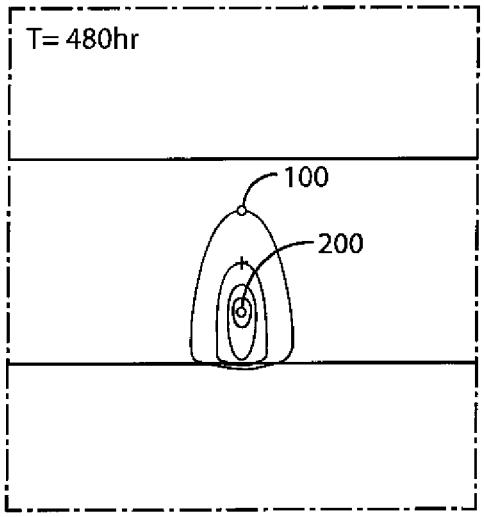
FIG. 8B is a second view of the computer simulation of FIG. 8A.
Figure 9A:
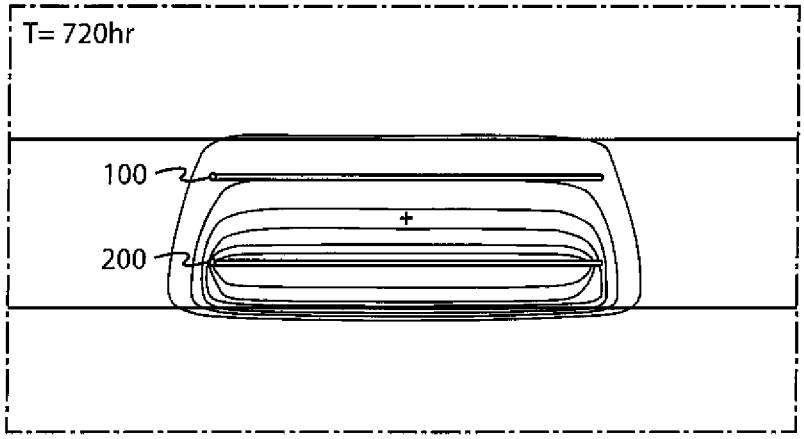
FIG. 9A is a first view of another simplified illustration of a computer simulation according to the present invention.
Figure 9B:
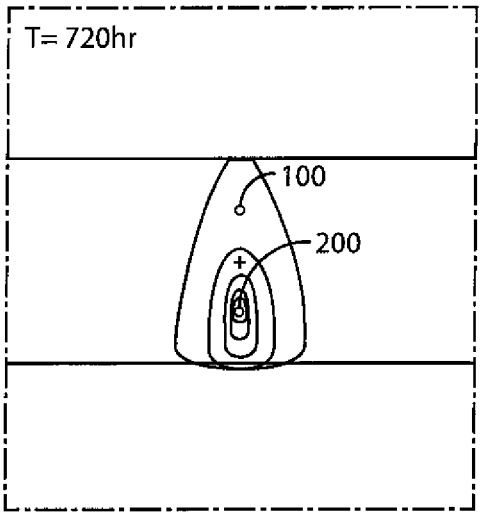
FIG. 9B is a second view of the computer simulation of FIG. 9A.
Figure 10A:
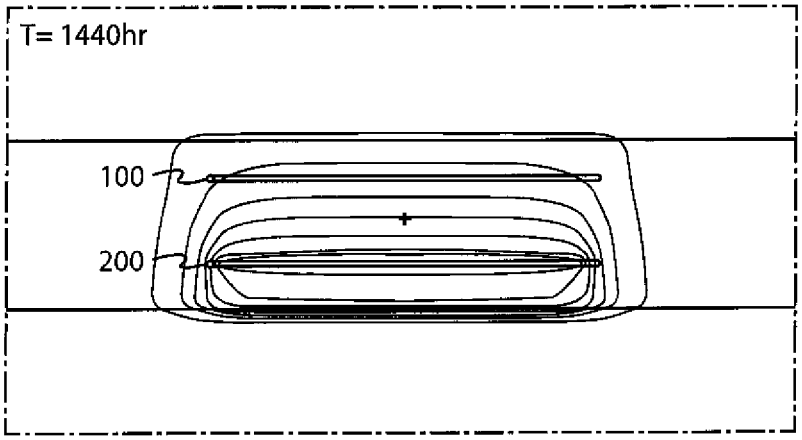
FIG. 10A is a first view of still another simplified illustration of a computer simulation according to the present invention.
Figure 10B:
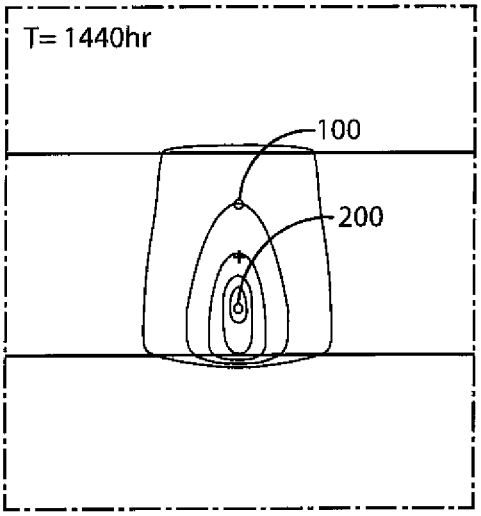
FIG. 10B is a second view of the computer simulation of FIG. 10A.

A first simulation is run according to a duration of 480 hours, whereby the computer model produces a graph of representative isopressures according to FIGS. 8A and 8B. A second simulation is run according to a duration of 720 hours, whereby the computer model produces a graph of representative isopressures according to FIGS. 9A and 9B. A third simulation is run according to a duration of 1440 hours, whereby the computer model produces a graph of representative isopressures according to FIGS. 10A and 10B.

The graphs are reviewed to determine the desired duration for stimulating the target interval 10 to modify the in-situ stress of the target interval 10 in the vicinity of a first deviated well 100. From a review of the generated graphs, a duration of 480 hours is chosen as an optimal duration time. Once the duration is established, the first and second deviated wells 100, 200 may be installed in the target interval 10 for fracturing and hydrocarbon recovery operations.

EXAMPLE 2

In a second non-limiting example, an unconventional reservoir of a target interval 10 in the Woodford Shale is selected for production purposes according to the system and method of this application. Located in south-central Oklahoma, U.S.A., the Woodford Shale ranges in depth from about 1829 meters to about 3353 meters (from about 6,000 feet to about 11,000 feet) according to the United States Department of Energy. The Woodford Shale play encompasses an area of about 17,703 $km^2$ (about 11,000 square miles). The average thickness of the Woodford Shale varies from about 36.6 meters to about 67.1 meters (from about 120 feet to 220 feet).

EXAMPLE 3

In a third non-limiting example, an unconventional reservoir of a target interval 10 is selected for production purposes. Prior to fracturing operations, the depth of the target interval 10, the cubic area of the rock formation of the target interval 10, the fracturization pressure of the target interval 10 and the permeability of the target interval 10 are determined. The depths of the first and second deviated wells 100, 200 are initially set according to their baseline depths of ⅓ and ⅔.

With attention to the simplified illustration of FIG. 7, the second deviated well 200 is suitably drilled at a lateral distance effective to induce fracture propagation from the most distal stage (Stage I) to the stage nearest the vertical portion of the well 100 (Stage V). In addition, the baseline depths of the first and second deviated wells 100, 200 are operationally effective to ensure that larger fractures 12A propagate across a majority of a target interval 10 between the wells 100, 200 relegating smaller volume fractures 12B directionally away from the second deviated well 200.

EXAMPLE 4

In a fourth non-limiting example, an unconventional reservoir of a target interval 10 is selected for production purposes according to the system and method of this application. Prior to fracturing operations, the depth of the target interval 10, the cubic area of the rock formation of the target interval 10, the fracturization pressure of the target interval 10 and the permeability of the target interval 10 are determined. The depths of the first and second deviated wells 100, 200 are initially set according to their baseline depths of ⅓ and ⅔.

Using this data, one or more computer model simulations are run at a stimulation pressure just under the fracturization pressure of the interval 10 to determine the duration of stimulation of the target interval 10 according to the baseline depths of the wells 100, 200. Once the duration of stimulation for the baseline depths is established, the depths of the first and second deviated wells 100, 200 may be adjusted as desired via calculations and/or computer modeling to meet a different duration of stimulation using the same stimulation pressure level.

EXAMPLE 5

In a fifth non-limiting example, an unconventional reservoir of a target interval 10 is selected for production purposes. Prior to fracturing operations, the depth of the target interval 10, the cubic area of the rock formation of the target interval 10, the fracturization pressure of the target interval 10 and the permeability of the target interval 10 are determined. Characteristics of the reservoir target interval 10 include:

target interval 10 thickness: 30.48 meters, 100.0 feet
permeability: 1 micro-Darcy,
porosity: 0.3
viscosity of the fluid in place: 1.0 cp
density of the fluid in place: 1.00 $g/cm^3$, 62.5 $lb/ft^3$
Compressibility of the fluid in place: 3.0 e−5 $psi^{-1}$
Young's modulus: $6.89475729\times10^9$ Pa, 1.0 e6 psi
Poisson's ratio: 0.2
overburden stress: 48263301.1 Pa, 7000.0 psi
maximum initial horizontal stress: 20684271.9 Pa, 3000.0 psi
minimum initial horizontal stress: 18615844.7 Pa, 2700.0 psi
initial reservoir pressure: 6894757.29 Pa, 1000.0 psi.

Figure 11:
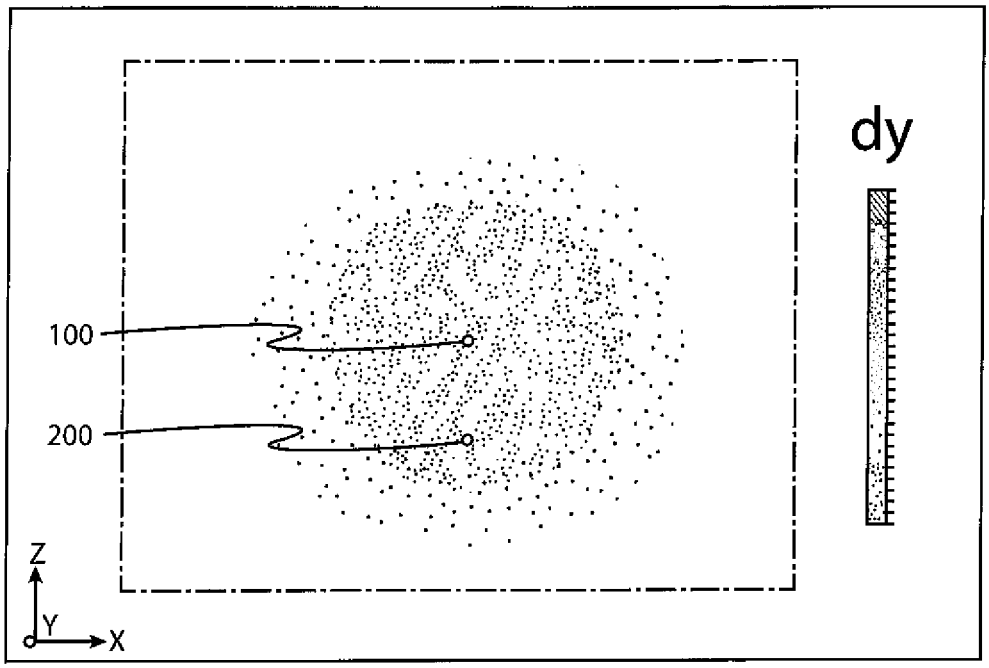
FIG. 11 is a view of computer simulation fracturization operation results according to the present invention.

Referring to FIG. 11, the primary and secondary deviated wells 100 and 200 are installed a distant apart about 4.57 meters (about 15.0 feet). According to reservoir characteristics, a first computer model simulation is performed for a fracturization operation of the target interval 10 at the primary well 100 only. Operation results are shown in FIG. 11, which represents the tensile deformation ("dy"—values given in the legend have been normalized) of the fracturization medium in the direction orthogonal to the fracture plane (such plane being along directions x and z as per FIG. 11). This corresponds to the predicted propagation of the fracture—a higher absolute value of dy predicts a larger opening of the fracture at that particular location.

Figure 12:
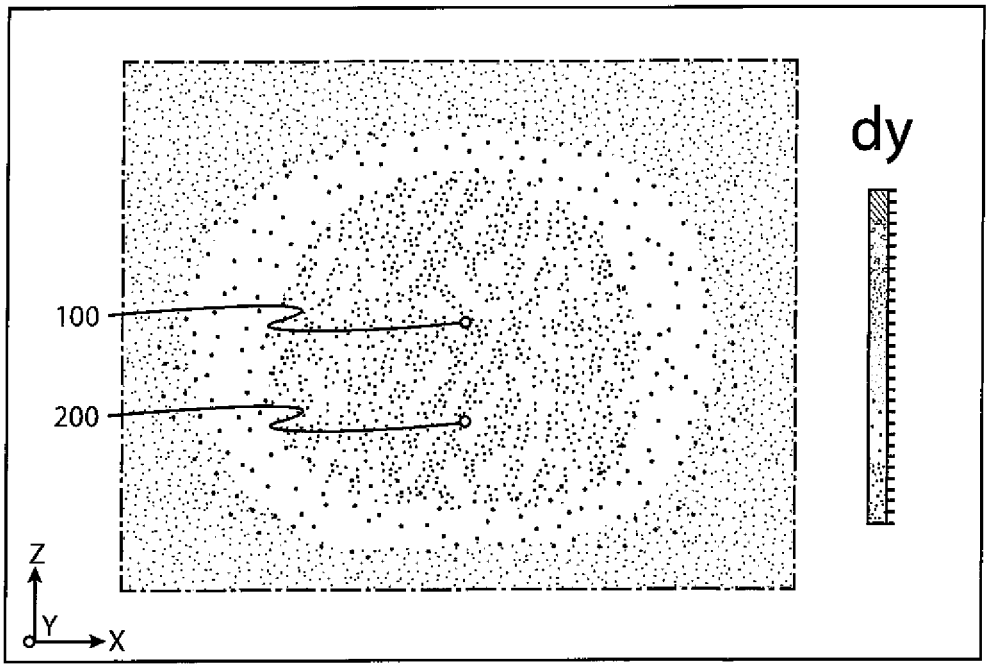
FIG. 12 is a view of computer simulation fracturization operation results according to the present invention.

Using the same reservoir characteristics, a second computer model simulation is performed wherein the secondary well 200 is used for initial injection of the target interval 10 for 75 days. During the initial injection operation, the bottom-hole pressure for the secondary well 200 is controlled at about 689475.73 Pa (about 100 psi) below the minimum horizontal stress to prevent any fracturing of the target interval 10 to occur. After 75 days of injection, the secondary well 200 is shut-in as understood by the skilled artisan and fracturization of the target interval 10 is performed via the primary well 100. FIG. 12 represents the tensile deformation of the medium in the direction orthogonal to the fracture plane. The comparison between FIGS. 11 and 12 demonstrate that the system and method of this application is effective to optimize and control the development of generated fractures in the target interval 10. In particular, the simulation results of FIG. 12 demonstrate that the fracture is larger and propagates further downward when a secondary well 200 is used before the primary well 100 to modify the in-situ stress of the target interval 10 during the first injection period, prior to the fracturization period.

One skilled in the art will recognize that while the teachings herein may be performed downhole, they are also applicable to evaluations conducted on the surface, such as in a laboratory or via a computer. For example, in one implementation at least a portion of the invention may be performed using computer modeling, while other measurements and determinations may be performed on location downhole.

While the invention has been described with reference to an exemplary embodiment or embodiments, it will be understood by those skilled in the art that various changes may be made and equivalents may be substituted for elements thereof without departing from the spirit and scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. The embodiment(s) described herein are meant to be illustrative only and should not be taken as limiting the invention, which is defined in the claims.

We claim:

1. A method of improving hydrocarbon fluid productivity of a primary deviated well in an unconventional low permeability porous subterranean target earth interval, comprising:

installing a secondary deviated well in the unconventional low permeability porous subterranean target earth interval substantially laterally aligned with the primary deviated well, the primary deviated well defining a first perforated interval, the secondary deviated well being located at a depth greater than the primary deviated well, the secondary deviated well defining a second perforated interval;

pressurizing the unconventional low permeability porous subterranean target earth interval via the secondary deviated well to induce localized modifications of effective stress between the primary and secondary deviated wells to promote fracture propagation directionally from the primary deviated well toward the second deviated well;

fracturing the unconventional low permeability porous subterranean target earth interval by delivering one or more fracturing fluids into the interval via the primary deviated well increasing fracture propagation directionally from the primary deviated well toward the second deviated well producing a desired fracture network volume between the primary and secondary deviated wells; and recovering the one or more fracturing fluids and the hydrocarbon fluid located in the unconventional low permeability porous subterranean target earth interval via the primary and secondary deviated wells.

2. The method of claim 1 wherein the distance between the primary and secondary deviated wells is effective to prevent fractures from propagating beyond either the uppermost edge of the unconventional low permeability porous subterranean target earth interval or the lowermost edge of the unconventional low permeability porous subterranean target earth interval.

3. The method of claim 2 wherein about 80.0 percent or more of the fracture network is located above the secondary deviated well.

4. The method of claim 1 wherein the second perforated interval is about equal to or greater in size than the first perforated interval.

5. The method of claim 1 wherein prior to pressurizing the unconventional low permeability porous subterranean target earth interval, the unconventional low permeability porous subterranean target earth interval is evaluated to determine in-situ properties selected from the group consisting of the permeability of the unconventional low permeability porous subterranean target earth interval, the fracturization pressure of the permeability of the unconventional low permeability porous subterranean target earth interval, the stress regimes affecting the stress anisotropy of the unconventional low permeability porous subterranean target interval, the stress anisotropy of the unconventional low permeability porous subterranean target interval, the presence, the mechanical properties of the unconventional low permeability porous subterranean target interval, the closure pressure of the unconventional low permeability porous subterranean target interval, and combinations thereof.

6. A method of improving fluid hydrocarbon productivity of an unconventional low permeability porous subterranean target earth interval, comprising:

determining the fracturization pressure, permeability, depth and distribution of in situ stress of the unconventional low permeability porous subterranean target earth interval;

providing a first deviated well at a first depth within the unconventional low permeability porous subterranean target earth interval and a second deviated well at a second depth, the second depth being greater than the first depth;

injecting pressurized fluid into the second deviated well up to a pressure just below the fracturization pressure of the unconventional low permeability porous subterranean target earth interval in a manner effective to modify stress conditions of the unconventional low permeability porous subterranean target earth interval between the first and second wells; and injecting one or more fracturing fluids into the first deviated well whereby the stress of the unconventional low permeability porous subterranean target earth interval influences fracture propagation toward the second deviated well producing a desired fracture network volume between the primary and secondary deviated wells.

7. The method of claim 6 wherein the second deviated well is installed in the target earth interval in a manner effective to maximize the capture and recovery of fracturing fluid injected into the target earth interval via the first deviated well.

8. The method of claim 6 wherein the second deviated well is directed in substantially parallel alignment with the first deviated well.

9. The method of claim 6 wherein the mode of determining permeability is selected from the group consisting of core analysis, nuclear magnetic resonance log, wireline formation tester, drill stem test, and combinations thereof.

10. The method of claim 6 wherein the second deviated well engages fractures propagated from the first deviated well.

11. The method of claim 6 wherein the first and second deviated wells act in concert to recover fracturing fluid and hydrocarbon based fluids from a unconventional low permeability porous subterranean target earth interval.

12. The method of claim 6 wherein the second deviated well is provided to pressurize the unconventional low permeability porous subterranean target earth interval in the vicinity of a first deviated well up to a pressure just below the determined fracturization pressure of the unconventional low permeability porous subterranean target earth interval.

13. The method of claim 6 whereby once the fracturization pressure, permeability, depth and distribution of in situ stress is determined, the information is used to establish (1) the depths of the first and second deviated wells effective for the second deviated well to pressurize the unconventional low permeability porous subterranean target earth interval, (2) the injection pressure of fluid into the second deviated well and (3) the duration of injecting pressurized fluid into the second deviated well effective to correct the in-situ stress near the first deviated well.

14. A method of improving hydrocarbon fluid productivity of a primary deviated well in an unconventional low permeability porous subterranean target earth interval, comprising:

(1) providing a system for fracturing an unconventional low permeability porous subterranean target earth formation, including:

a fracture inducing assembly deliverable to a first location in an unconventional low permeability porous subterranean target earth formation and operationally configured to induce fractures in the unconventional low permeability porous subterranean target earth formation; and a pressure inducing assembly deliverable to a second location in the unconventional low permeability porous subterranean target earth formation and operationally configured to pressurize the unconventional low permeability porous subterranean target earth formation in a manner effective to induce selective fracture formation from the fracture inducing assembly directionally toward the pressure inducing assembly;

(2) installing the fracture inducing assembly at a first depth and installing the pressure inducing assembly at a second depth greater than the first depth in the unconventional low permeability porous subterranean target earth interval, the fracture inducing assembly defining a first perforated interval, the pressure inducing assembly defining a second perforated interval;

(3) pressurizing the unconventional low permeability porous subterranean target earth interval via the pressure inducing assembly up to a pressure just below the fracturization pressure of the unconventional low permeability porous subterranean target earth interval to induce localized modifications of effective stress between the fracture inducing assembly and the pressure inducing assembly;

(4) fracturing the unconventional low permeability porous subterranean target earth interval by delivering one or more fracturing fluids into the interval via the fracture inducing assembly thereby increasing fracture propagation directionally toward the pressure inducing assembly producing a desired fracture network volume there between; and (5) recovering the one or more fracturing fluids and hydrocarbon fluid located in the unconventional low permeability porous subterranean target earth interval via the fracture inducing assembly and the pressure inducing assembly.

15. The method of claim 14 wherein the depths of the fracture inducing assembly and the pressure inducing assembly may be determined prior to installation in a manner effective to optimally correct stress in the vicinity of the fracture inducing assembly without reaching a fracturization pressure of the unconventional low permeability porous subterranean target earth interval.

16. The method of claim 14 wherein the system further includes pressurized fluid deliverable to the second location and one or more fracturing fluids deliverable to the first location.

* * * * *